United States Patent [19]

Leitgib

[11] 4,403,945

[45] Sep. 13, 1983

[54] GAS LIGHTER FOR SMOKERS

[75] Inventor: Imre Leitgib, Vesenaz, Switzerland

[73] Assignee: Usiflamme S.A., Villars-sur-Glane, Switzerland

[21] Appl. No.: 199,271

[22] Filed: Oct. 21, 1980

[30] Foreign Application Priority Data

Oct. 30, 1979 [FR] France ..... 79 26889

[51] Int. Cl.[3] ..... F23Q 2/00

[52] U.S. Cl. ..... 431/150; 431/146; 431/256

[58] Field of Search ..... 431/130, 131, 132, 150, 431/152, 146, 254, 255, 256

[56] References Cited

U.S. PATENT DOCUMENTS

| | | | |
|---|---|---|---|
| 3,251,202 | 5/1966 | Racek | 431/131 |
| 3,592,576 | 7/1971 | Hocq | 431/131 |
| 4,144,018 | 3/1979 | Tanaka | 431/131 |

*Primary Examiner*—Samuel Scott
*Assistant Examiner*—Carl Price
*Attorney, Agent, or Firm*—Brisebois & Kruger

[57] ABSTRACT

The lighter has a cover which, in its closed position, moves an actuating lever for the gas valve to a retracted position in which the lever cannot be actuated to open the valve. When the cover is open, the lever is moved to an operating position in which the user can operate the lever to open the valve and ignite the gas then flowing through the valve.

8 Claims, 18 Drawing Figures

GAS LIGHTER FOR SMOKERS

The present invention relates to a gas lighter for smokers, more particularly of the type having a body, a cover able to delimit with the body an interior space when it is in a closed position and a valve mounted on the body in the space to move from a closed position in which the flow of gas is prevented to an open position which allows the gas to escape.

Such automatic or semi-automatic gas lighters are already known in which the gas is released when the cover is opened. The disadvantage of lighters of this known type resides in the fact that the gas continues to escape as long as the cover is not reclosed. This means, in particular, that in case it is dropped, the lighter may remain lighted. Moreover, because the gas escapes all the time that the cover is open, these lighters use a relatively large amount of gas. This point is particularly critical for electric or electronic lighters which are generally provided with a gas reservoir of small volume because of the large size of the mechanism.

The present invention aims to overcome these disadvantages by providing a gas lighter with improved safety of use and which, in addition, permits saving gas.

To this end, the present invention has as its object a gas lighter including a body, a cover able to delimit with the body an interior space when it is in a closed position, and a valve mounted on the body in the space to move from a closed position in which the escape of gas is prevented to an open position which allows the gas to escape, characterized by the fact that it includes a valve lever mounted on the body to allow the opening of the valve, this valve lever being moveable from a retracted position in which it is entirely contained within the space, to an operating position in which it may be operated by the user, means connected to the cover being provided to move the valve lever from its retracted position to its operating position when the cover is moved from its closed position to its open position.

Thus, the gas can only escape from the valve as long as the user keeps a finger pressing on the valve lever. In particular, in the case of a fall, the lighter goes out. In addition, the valve lever being in its retracted position inside the cover, it follows that it cannot be operated inadvertently when the lighter is closed.

The gas lighter according to the invention can be a friction wheel lighter, the position of the valve lever being such that it may be operated by the same finger of the user as that which causes the rotation of the wheel.

As a variation, the lighter according to the invention, is an electric lighter, a switch placed in the lighting circuit being designed to be closed by the valve lever in the position where this valve lever causes the opening of the valve.

In a first embodiment, the cover can be raised from the body by sliding, elastic means urging the valve lever toward the operating position and a cam in the form of a wedge attached to the cover cooperating with a surface of the valve lever to bring it back to the retracted position when the cover is replaced on the body.

According to another embodiment, the cover is mounted pivotally on the body, means being provided to transform its pivoting movement to a movement of the valve lever between its retracted position and its operating position.

In this latter case, the means to transform the pivoting movement of the cover to a movement of the valve lever can comprise a curved bar attached to the cover and passing through an opening located in the valve lever.

In a variation, the means can comprise an arm of the lever connected to the cover and a stop mounted on the body, a first bar being articulated at one of its ends to the arm of the lever and at its other end to a second bar articulated, for example, on the valve lever, a compression spring being placed between the stop and the articulation of the first bar on the arm of the lever.

According to another variation, the means comprises a cam attached to the cover cooperating with a surface of the valve lever to bring it into the operating position, and a spring to hold this surface pressed against the cam.

Other characteristics and advantages of the invention will become apparent in the following description which will be given by way of non-limiting example of several of these embodiments.

In the attached schematic drawings:

FIG. 1 is a partial view, in section, of a first embodiment of a gas lighter with a friction wheel, according to the invention, with its cover in the closed position;

FIG. 2 corresponds to FIG. 1 and shows the lighter with its cover in the open position;

Figure 4:
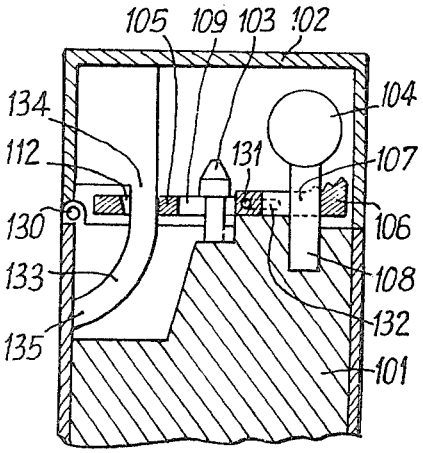
FIG. 4 is a partial sectional view of a second embodiment of a gas lighter with a friction wheel, according to the invention, with its cover in the closed position.
Figure 5:
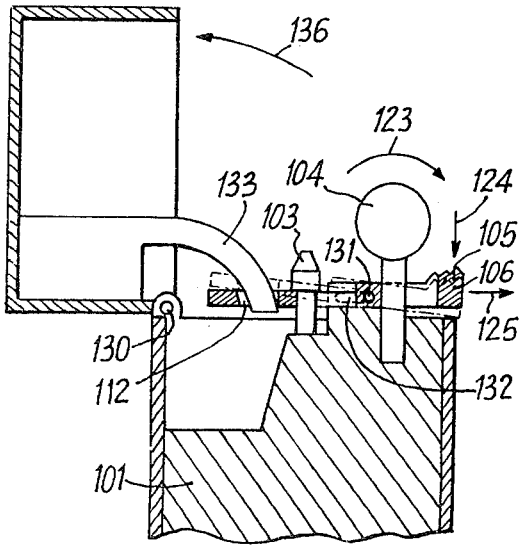
Figure 6:
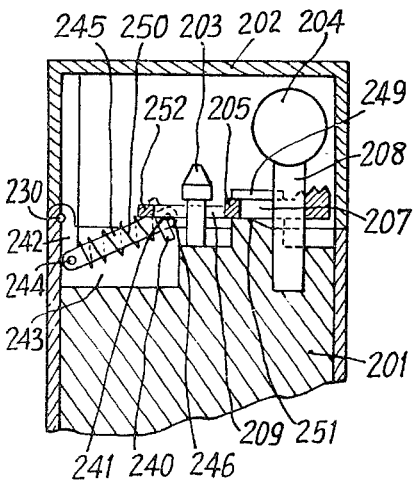
Figure 7:
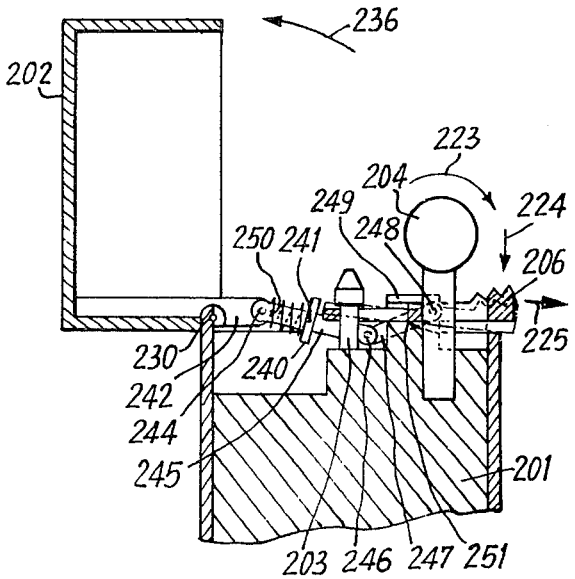
Figure 8:
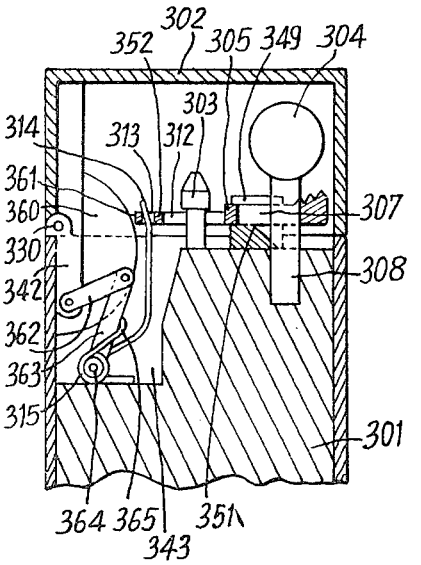
Figure 9:
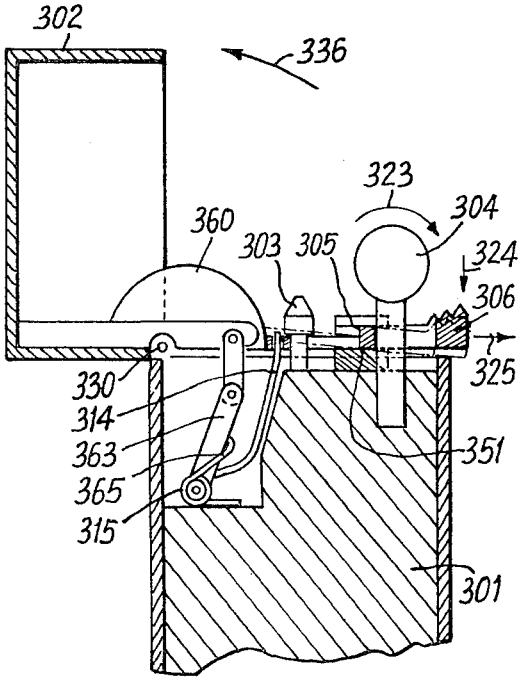

FIG. 5 corresponds to FIG. 4 and shows the lighter with its cover in the open position;

FIG. 6 is a partial sectional view of a gas lighter with a friction wheel according to the invention with its cover in the closed position;

FIG. 7 corresponds to FIG. 6 and shows the lighter with its cover in the open position;

FIG. 8 is a partial sectional view of another embodiment of a gas lighter with a friction wheel according to the invention, with its cover in the closed position;

FIG. 9 corresponds to FIG. 8 and shows the lighter with its cover in the open position; and FIGS. 10 to 18 show embodiments of an electric lighter according to the invention, and correspond respectively to FIGS. 1 to 9.

Figure 1:
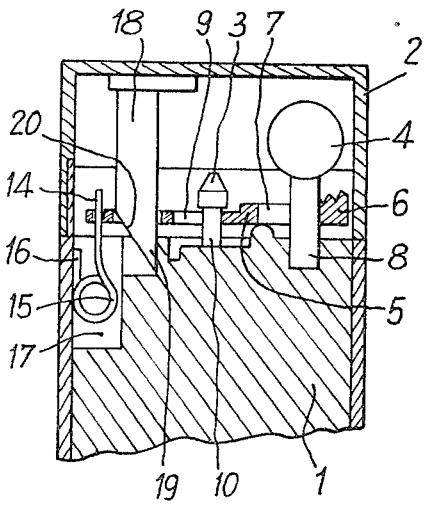
Figure 2:
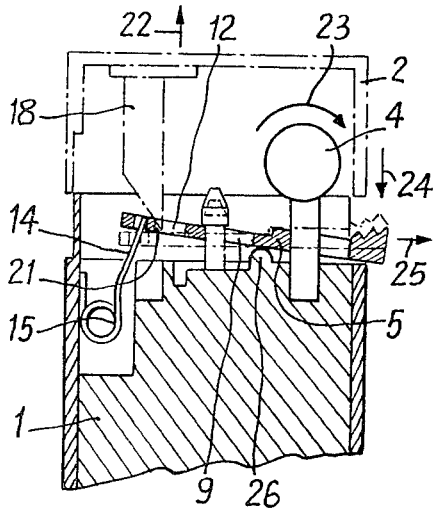
Figure 3:
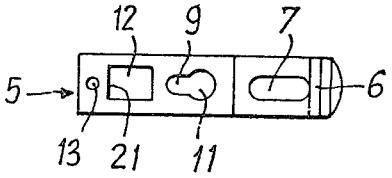
FIG. 3 is a top view of the valve lever of the lighter of FIGS. 1 and 2.

Referring now to FIGS. 1 to 3, one sees a lighter having a body 1 and a cover 2. This lighter includes, in a known manner, a gas valve 3, moveable axially, that is to say, generally perpendicular to the top surface of the body 1. When the valve 3 is in the position of deepest penetration into the body 1, it stops the emission of the gas, then when it is drawn out toward the exterior of the body 1, the gas can escape. Elastic means not shown, such as for example, a spring, acts on the valve 3 to maintain it in its depressed position in the body 1. Also in a known manner, the lighter according to the invention, includes a friction wheel 4 mounted on the body 1 which, when it is activated by the finger of the user, produces a spark which ignites the gas emitted through the valve 3.

According to the invention, the lighter includes a valve lever 5 mounted to slide on the body 1 between a retracted position shown on FIG. 1 and an operating position shown in broken lines on FIG. 2.

This valve lever 5 comprises at its front portion a knurled front end 6 to permit convenient contact with the finger of the user. An elongated opening 7 is, for example, provided in the valve lever 5 to receive the friction wheel mechanism 8 and to allow the lever to slide on either side of this mechanism. Another elongated opening 9 receives the stem of the valve 10 and comprises at its front part an enlarged portion 11 permitting the passage of the head of the valve. Another opening 12 is provided in the valve lever 5 behind opening 9. The function of this opening 12 which is basically of rectangular section will be explained later. Finally, the valve lever has at its rear portion a drilled opening 13 to receive an arm 14 of a helical spring 15 of which the other arm 16 is fixed to the body 1 of the lighter in a recess 17. The spring 15 is such that when its end 14 is engaged in the opening 13, it urges the valve lever 5 toward the operating position, that is to say, toward the right on FIGS. 1 and 2.

In addition, inside the cover 2 is fixed a finger 18, whose extremity 19 forms a cam surface in the shape of a wedge 20 capable of cooperating with the rear surface 21 of the opening 12 of the valve lever 5. When the valve lever 5 is in this retracted position shown on FIG. 1, the finger 18 is immediately above the opening 12.

The operation of this lighter will now be more particularly described with reference to FIG. 2.

When the cover 2, shown on this Figure in broken lines, is raised above the body 1 by sliding in the direction of the arrow 22, the valve lever 5 which is no longer maintained in its retracted position by the surface of the cam 20 of the finger 18, is pushed outwardly to its operating position by the end 14 of the spring 15. This movement is effected in the direction of the arrow 25.

The friction wheel 4 can also be rotated in the direction of arrow 23 by the finger of the user, which produces the desired spark. Then the finger of the user continues its movement downwardly in the direction of arrow 24 and comes onto the front knurled part 6 of the valve lever 5 thus causing it to pivot around a boss 26 of the body 1. In this movement, the edges of the rear extremity of the opening 9 cooperate with the valve 3 to the position where it permits the gas to escape. The gas is then ignited by the spark produced by the friction wheel 4.

On FIG. 2 the valve lever 5 is shown in broken lines in the operating position before it has been activated by the finger of the user, and in solid lines in the operating position where the finger of the user has caused it to pivot. If the user relaxes his pressure on the knurled front end 6 of the valve lever 5, this latter returns to the position shown in broken lines under the effect of the valve head of the valve 3, so that the gas stops escaping. This occurs, for example, in the case where the lighter is dropped or also when the user prepares to close it.

After use, the cover 2 is engaged again on the body 1. In this movement, the tip of the surface of the cam 20 comes into contact with the surface 21 of the opening 12 of the valve lever 5 and, gradually as the cover 20 causes against the action of the spring 15, movement of the valve lever 5 from the operating position to the retracted position where the cover will be completely lowered onto the body 1.

In the embodiment shown on FIGS. 4 and 5, the lighter according to the invention, includes likewise a body 101 and a cover 102. The cover is mounted in this case, pivotably on the body 101 on a hinge 130.

The valve lever 105 also has a knurled front end 106 and an elongated opening 107 permitting it to slide on either side of the mechanism 108 of the friction wheel 104. It also has an elongated opening 109 cooperating, in the same manner as the embodiment above, with the valve 103 of the lighter.

However, in this embodiment, the valve lever 105 has two lateral guide lugs 131 capable of sliding in slots 132 of the body 101, to guide the displacement of the valve lever 105 from its retracted position shown on FIG. 4 to its operating position shown in solid lines on FIG. 5.

The valve lever 105 includes, for example, an opening 112 similar to the opening 12 of the valve lever 5.

In this embodiment, a curved bar 133 is secured to the cover 102 to cooperate with the opening 112 of the valve lever 105. This curved bar 133 can be made in an approximately helical shape and swings around the hinge 130 along its length from between its end 134 attached to the cover 102 and its opposite free end 135.

In the embodiment shown on the drawings, the curved bar 133 is formed as an arc of a circle eccentric with respect to the hinge 130.

If one now refers to FIGS. 4 and 5, one sees that the lighter is opened by pivoting its cover 102 around the hinge 130 in the direction of the arrow 136. In this movement, the curved bar 133 acts as a cam with respect to the opening 112 of the valve lever 105.

Thus in the closed position of the lighter, it is the end 134 of the bar 133 which traverses the opening 112, and it is its end 135 which traverses it in its open position; it thus results that the valve lever 105 moves from its retracted position to its operating position following the arrow 125.

The rest of the procedure is carried out in the same manner as for the lighter shown on FIGS. 1 and 2, namely the rotation of the friction wheel 104 in the direction of the arrow 123 and the driving by the finger of the user of the end 106 of the valve lever 105 in the direction of the arrow 124. In this movement, the valve lever 105 pivots around the lugs 131 which are displaced from the rear end of slots 132 to their front ends.

This then results in the lifting of the valve 103, which permits the emission of the gas which is ignited by the spark provided by the friction wheel 104.

When the pressure of the finger on the end 106 of the valve lever 105 is relaxed, the valve 103 resumes its lowered position in the body 101 so that the lighter is extinguished.

If the lighter is then closed by pivoting the cover 102 around the hinge 130, in the direction opposite to that of the arrow 136, the curved bar 133 cooperating with the opening 112 of the valve lever 105 causes the return to the retracted position of the valve lever 105, the lugs 131 sliding in a reverse direction in the slots 132 of the body 101. The valve lever 105 being retracted, the cover 102 can be completely closed.

The lighter shown on FIGS. 6 and 7 includes in the same manner as the preceding, a body 201, a cover 202 mounted to pivot on the body 201 around a hinge 230, a valve 203, a friction wheel 204 and a valve lever 205.

A stop 240 is pivotally mounted on the body 201 by means not shown around a axle 241.

In addition, a lever 242 is solidly mounted on the cover 202 and is disposed, in the closed position of the lighter, in a recess 243 of the body 201. At the end of the lever 242 is articulated a first bar 245 which, at its other end 246 is articulated on a second bar 247 itself articulated at its end 248 on the valve lever 205 (FIG. 7).

One has, in addition provided on the body 201 of the lighter a slide 249 which permits the sliding of the valve lever 205 from its retracted position shown on FIG. 6 to the operating position shown in solid lines of FIG. 7. The valve lever 205 has, as previously shown, an opening 207 in which is engaged the mechanism 208 of the friction wheel 204, and an opening 209 capable of cooperating with the valve 203.

Finally, there is a compression spring 250 placed around the first bar 245 between its end 244 which is joined to the lever 242, and the pivoting stop 240.

In the position shown on FIG. 6, the compression spring 250 pushes the end 244 of the lever 242 back toward the left of the drawing, which keeps the cover 202 closed.

When the cover 202 is opened (FIG. 7) by pivoting around the hinge 230 in the direction of the arrow 236, the end 244 of the lever 242 pushes the first bar 245 which, itself, pushes the second bar 247. The articulations 244,246 and 248 permit this movement which causes the displacement of the valve lever 205 in the direction of the arrow 225. In this movement, the valve lever 205 slides in the guides 249 of the body 201 and assumes the operating position.

When the lighter is in the position shown on FIG. 7, the compression spring 250, which has pivoted around the axle 241 and the articulation 244, holds the cover open.

The spark is then produced by rotation of the friction wheel 204 in the direction of the arrow 223, after which, the end 206 of the valve lever 205 is pushed in the direction of the arrow 224 to bring the valve lever 205 to the position shown in broken lines on FIG. 7. This movement is effected by pivoting of the valve lever 205 around the edge 251 of the body 201 by virtue of a slight reduction of thickness of the rear part 252 of the valve lever 205, this reduction in thickness allowing pivoting of the valve lever 205 in spite of the guides 249.

When the pressure on the end 206 of the valve lever 205 is released, the lighter is extinguished and then cover 202 can be reclosed. In this movement, around the hinge 230, the pivoting of the end 244 of the lever 242 pulls the bars 245 and 247 and as a result, a movement of the valve lever 205 in the direction opposite to that of the arrow 225. The valve lever 205 being thus again in the retracted position, the cover 202 can be completely closed.

The lighter shown on FIGS. 8 and 9 has in the same manner a body 301, a cover 302 mounted to pivot on the body 301 around a hinge 330, a valve 303, a friction wheel 304 and a valve lever 305. The valve lever is slidably mounted in the guides 349 of the body 301 and has a rear part 352 with reduced thickness to permit its pivoting around an edge 351 of the body 301. As previously, the valve lever 305 has an opening 307 in which is engaged the mechanism 308 of the friction wheel 304 and another opening 312 of which the edges are able to cooperate with the valve 303.

The valve lever 305 has also a rear opening 313 in which is engaged the end 314 of a spring 315 mounted on the body 301.

In addition, a cam 360 is rigidly mounted on the cover 302. This cam 360 has the form of a circular sector the axis of which is displaced with respect to the hinge 330 toward the body 301.

This cam is able to cooperate with the surface of the end 361 of the valve lever 305 to bring it from the retracted position shown on FIG. 8 to the operating position shown in solid lines on FIG. 9.

In addition, a lever 342 is likewise solidly mounted on the cover 302 and is, when the cover is closed, lodged in a recess 343 of the body 301. At the end of the lever 342 is articulated a first bar 362 which at its other end is articulated on a second bar 363 pivotally mounted at its end 364 on the body 301 in its recess 343. Another arm 365 of the spring 315 urges the bar 363 toward the left of FIG. 8.

When the lighter is in the closed position shown on FIG. 8, the arm 365 of the spring 315 holds it closed in pushing back the lever 342 by means of the bar 363.

If the cover 302 is opened by pivoting around the hinge 330 in the direction of the arrow 336 (FIG. 9), the cam 360 pushes the valve lever 305 in the direction of the arrow 325 to place it in its operating position.

The friction wheel 304 can also be activated in the direction of the arrow 323 to produce a spark after which, the valve lever 305 is pushed by its end 306 in the direction of the arrow 324. This results in a pivoting around the edge 351 of the body 301 and a raising of the valve 303 which allows the escape of the gas which ignites.

When the pressure on the end 306 of the valve lever 305 is released, the lighter is extinguished.

If the lighter is then closed by pivoting the cover 302 in the opposite direction to the arrow 336, the arm 314 of the spring 315 then maintains the edge 361 of the valve lever 305 in contact with the cam 360 causing the displacement of the valve lever 305 in a direction opposite to that of arrow 325, that is to say, it returns to the retracted position. The cover 302 is then completely closed by the pressure exerted by the end 365 of the spring 315 on the bar 363.

FIGS. 10 to 18 show electrical lighters according to the invention in different embodiments corresponding to the lighter shown on FIGS. 1 to 9.

Figure 10:
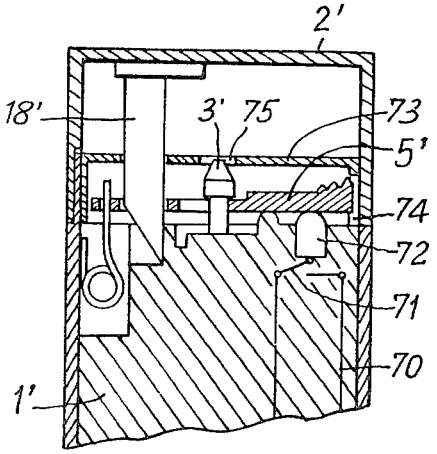
Figure 11:
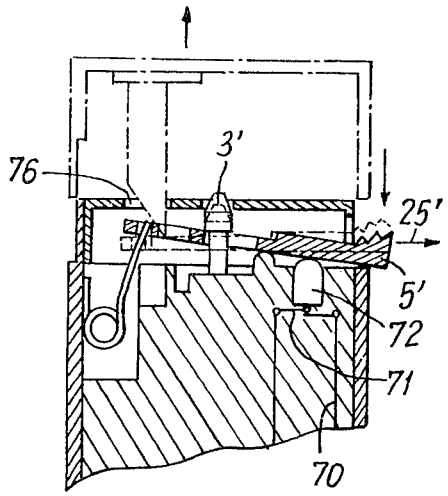
Figure 12:
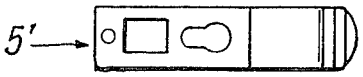

If one refers particularly to FIGS. 10 to 12 which correspond respectively to FIGS. 1 to 3, one finds a lighter having a body 1', a cover 2', a valve 3' and a valve lever 5'.

An ignition circuit 70 has a switch 71 operated by the action of a push button 72 placed in such a manner as to be activated by the valve lever 5'.

The other elements of the mechanism of the lighter of FIG. 10 are identical to those of the mechanism of the lighter of FIG. 1 and will not as a consequence, be described in further detail.

One finds on FIG. 11 which shows the lighter of FIG. 10 with its cover 2' lifted, that the valve lever 5' is displaced in the direction of the arrow 25' toward the operating position where it may be operated by the finger of the user. It is thus moved from the position shown in broken lines to the position shown in solid lines where on one hand, it causes the pushing in of the push button 72 which closes the switch 71 of the ignition circuit 70 and at the same time lifts the valve 3' which causes the flow of the gas which is ignited by means of the ignition circuit.

As in the lighter of FIGS. 1 to 3, when the pressure of the finger is released on the end of the valve lever 5', the lighter is extinguished and it may be reclosed.

One observes that one has presented here as a variation of the lighter shown on FIGS. 1 to 3 a cover 73 having an opening 74 for the passage of the valve lever 5', another opening 75 for the passage of the valve 3' and a third opening 76 for the passage of the rod 18' solidly attached to the cover 2' of the lighter.

Figure 13:
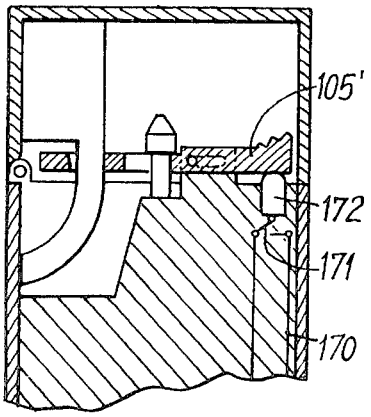
Figure 14:
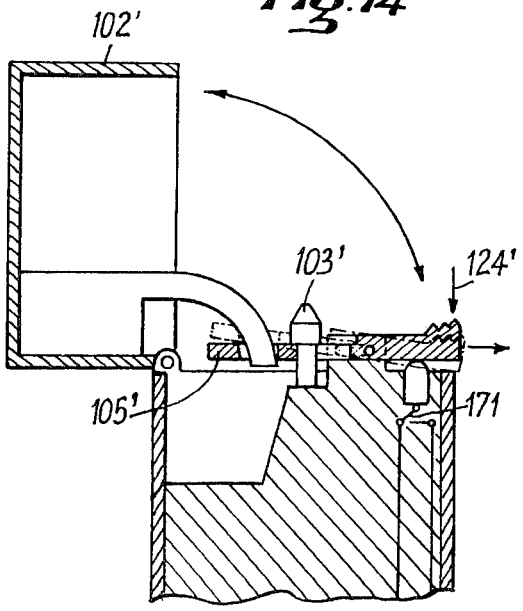

FIGS. 13 and 14 show a lighter of which the mechanism is identical to that of the lighter of FIGS. 4 and 5 and are not as a result described in detail.

A push button 172 is provided underneath the valve lever 105' and permits the closing of the switch 171 placed in the ignition circuit 170 of the lighter.

One sees on FIG. 14 the lighter of FIG. 13 with its cover 102' open and its valve lever 105' in operating position. The valve lever 105' is pressed down in the direction of arrow 124' to cause the opening of valve 103' and the closing of switch 171.

Figure 15:
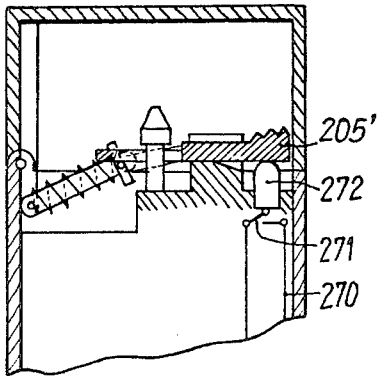
Figure 16:
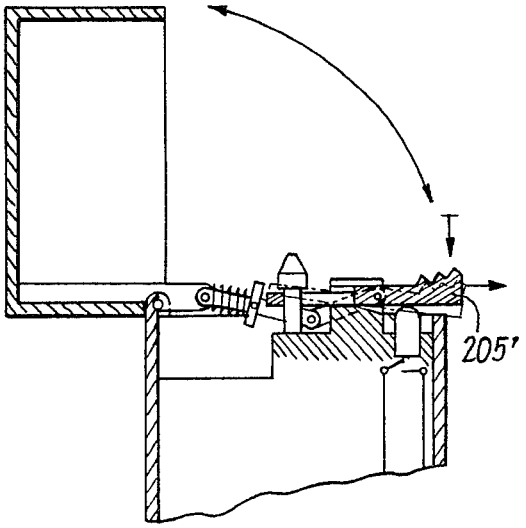

The electric lighter shown on FIGS. 15 and 16 is similar to that shown in FIGS. 6 and 7.

It has, in any case, a push button 272 provided to close a switch 271 in the ignition circuit 270 of the lighter.

The displacement of the valve lever 205' from its retracted position on FIG. 15 to its operating position shown in solid lines on FIG. 16 is accomplished in the manner which has been described with reference to FIG. 7. The lighting of the lighter is accomplished like that of the lighters shown on FIGS. 10 and 13.

Figure 17:
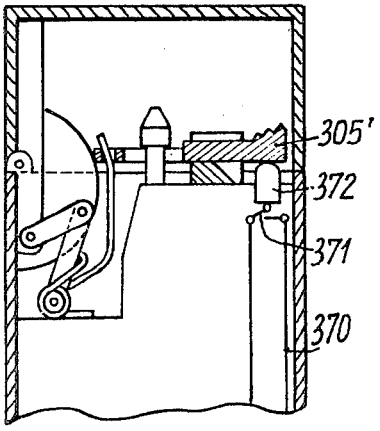
Figure 18:
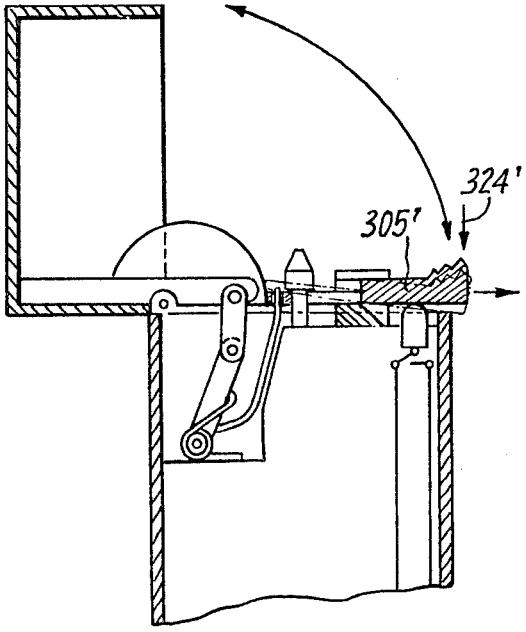

Likewise the lighter shown on FIGS. 17 and 18 is an electric lighter similar to the lighter shown on FIGS. 8 and 9 and the movement of the valve lever 305' from its retracted position shown on FIG. 17 to the operating position shown in solid lines on FIG. 18 is accomplished in the same manner.

A push button 372 is placed beneath the valve lever 305' to permit at the moment of its being pressed down in the direction of the arrow 324' the closing of the switch 371 placed in the ignition circuit 370 of the lighter.

One recognizes, as a consequence that in these different embodiments, the lighter according to the invention permits the extinguishing of the flame when the pressure on the valve lever is released. It thus results particularly in a reduced consumption of gas and much greater safety of use because the lighter is extinguished automatically in case it is dropped.

Furthermore, the fact that the valve lever is retractable, prevents its accidental activation and makes it possible to give the lighter an attractive appearance.

I claim:

1. Gas lighter comprising a body, a cover movable between an open position and a closed position relative to the body, and defining with the body, an interior space when the cover is in the closed position on the body, a valve mounted on the body in said space to be moved from a closed position, in which flow of gas is prevented, to an open position which permits the gas to flow, a valve lever mounted on said body to permit the opening of the valve, said valve lever being movable from a retracted position where it is entirely contained in said space to an operating position extending outside said space where it can be activated by the user to open the valve, and means to displace the valve lever from its retracted position to the operating position in response to displacement of the cover from its closed position to its open position, and wherein the lighter is a lighter with a friction wheel, the operating position of the valve lever being such that it can be activated by the same finger of the user as that which provides the rotation of the wheel.

2. Gas lighter comprising a body, a cover movable between an open position and a closed position relative to the body, and defining with the body, an interior space when the cover is in the closed position on the body, a valve mounted on the body in said space to be moved from the closed position, in which flow of gas is prevented, to an open position which permits the gas to flow, a valve lever mounted on said body to permit the opening of the valve, said valve lever being movable from a retracted position where it is entirely contained in said space to an operating position where it can be activated by the user to open the valve, and means to displace the valve lever from its retracted position to the operating position in response to displacement of the cover from its closed position to its open position, and wherein the lighter is an electric lighter, a switch placed in an ignition circuit being capable of being closed by the valve lever in the position where the valve lever causes the opening of the valve.

3. Gas lighter comprising a body, a cover movable between an open position and a closed position relative to the body, and defining with the body, an interior space when the cover is in the closed position on the body, a valve mounted on the body in said space to be moved from a closed position, in which flow of gas is prevented, to an open position which permits the gas to flow, a valve lever mounted on said body to permit the opening of the valve, said valve lever being movable from a retracted position where it is entirely contained in said space to an operating position extending outside said space where it can be activated by the user to open the valve, and means to displace the valve lever from its retracted position to the operating position in response to displacement of the cover from its closed position to its open position.

4. Lighter according to any one of claims 1–3 wherein the cover can be lifted from the body by sliding wherein said means to displace the valve lever includes spring means to urge the valve lever toward the operating position when the cover is lifted from the body, and a cam in the form of a wedge fixed in the cover cooperating with one surface of the valve lever to displace the valve lever to the retracted position when the cover is replaced on the body.

5. Lighter according to claim 3 wherein the cover is pivotally mounted on the body, and said means comprises means to displace the valve lever to transform pivotal movement of the cover to movement of the valve lever between the retracted and the operating position.

6. Lighter according to claim 5, wherein said means include a curved bar fixed to the cover and passing through an opening provided in the valve lever.

7. Lighter according to claim 5, wherein said means to displace the valve lever includes a lever fixed to the cover and a stop mounted on the body, a first bar being articulated at one of its ends to the lever and at its other end to one end of a second bar having a second end articulated in addition on the valve lever, a compression spring being placed between the stop and the articulation of the first bar on the arm of the lever.

8. Lighter according to claim 5, wherein said means to displace the valve lever include a cam fixed on the cover and cooperating with a surface of the valve lever to displace the lever to the retracted position when the cover is closed, and a spring to urge this surface against the cam and to displace the lever to the operating position when the cover is opened.

* * * * *